United States Patent [19]

Schultz

[11] Patent Number: 4,971,365

[45] Date of Patent: Nov. 20, 1990

[54] HYDRAULIC SAFETY JOINT

[75] Inventor: Roger L. Schultz, Plano, Tex.

[73] Assignee: Halliburton Company, Duncan, Okla.

[21] Appl. No.: 416,755

[22] Filed: Oct. 3, 1989

[51] Int. Cl.[5] ..... E21B 23/00; E21B 31/00; F16L 27/12

[52] U.S. Cl. ..... 285/2; 166/301; 166/317; 285/3; 285/81

[58] Field of Search ..... 166/301, 377, 386, 237, 166/123, 181, 317; 285/3, 4, 2, 81; 175/321

[56] References Cited

U.S. PATENT DOCUMENTS

| | | | |
|---|---|---|---|
| 2,585,995 | 2/1952 | Brown | 175/321 X |
| 3,368,829 | 2/1968 | Barrington et al. | 285/81 |
| 3,842,914 | 10/1974 | Mott | 166/377 |
| 3,963,228 | 6/1976 | Karle | 175/321 X |
| 4,054,040 | 10/1977 | Medders | 175/321 X |
| 4,211,290 | 7/1980 | Mason et al. | 175/321 |
| 4,484,633 | 11/1984 | Brandell | 166/301 |

OTHER PUBLICATIONS

Halliburton Sales & Service Catalog No. 43, published in 1985, pp. 2539–2540, 2574.

*Primary Examiner*—Stephen J. Novosad

*Attorney, Agent, or Firm*—James R. Duzan; Neal R. Kennedy

[57] ABSTRACT

A hydraulic safety joint for use in a downhole tool string. The hydraulic safety joint includes a mandrel assembly slidably disposed in a case assembly such that a chamber is defined therebetween. The chamber is filled with a volume of fluid so that the mandrel is held in a first operating position. When in this first position, the mandrel is in splined engagement with a nipple at the lower end of the case assembly. Upon application of a predetermined tensile load on the tool string, a rupture disc in communication with the fluid chamber is ruptured so that the fluid is vented therefrom. When the pressure is thus released, the mandrel assembly is moved to a second position in which it is further extended from the case assembly. In this position, the mandrel assembly is no longer in splined engagement with the nipple, but a series of lugs prevents relative rotation between the mandrel assembly and an upper portion of the case assembly. The tool string may then be rotated to break the threaded connection between the nipple and the rest of the case assembly so that the tool string components above the nipple may be removed from the well bore.

20 Claims, 3 Drawing Sheets

HYDRAULIC SAFETY JOINT

BACKGROUND OF THE INVENTION

1. Field Of The Invention

This invention relates to safety joints used in downhole tool strings, and more particularly, to a hydraulic safety joint having a hydraulic pressure relief means for actuation of the safety joint.

2. Description Of The Prior Art

Safety joints are commonly used in the petroleum industry, the object being to provide a capability for retrieving as many stands of a pipe string as possible as well as any associated tools when a portion of the pipe string becomes stuck in a well bore, a not uncommon occurrence during drilling and open hole testing. In particular, during tubing conveyed perforation operations, the perforating guns sometimes become stuck in the well bore making it difficult or impossible to unset the retrievable packer being used in the operation. This situation requires a secondary operation to cut the work string below the packer and above the perforating guns so that the packer may be unset and the work string, excluding the perforating guns, removed from the well. When it is necessary to cut the work string in this manner, there is the additional cost for the recovery operation and the loss of time associated with it. In addition to this disadvantage, the recovery operation does not always leave an upper end on the perforating gun portion which will facilitate fishing operations which must be performed later to remove the guns. Thus, some sort of safety joint between the packer and the guns is desirable.

Two prior art safety joints of conventional design are the Halliburton Services VR safety joint and anchor pipe safety joint, disclosed in Halliburton Sales & Service Catalog No. 43, pages 2539–2540. The VR safety joint is operated by reciprocating the pipe string up and down while maintaining right-hand torque. Pipe string reciprocation and right-hand torque backs off a left-hand exterior threaded nut within the housing. The nut prevents the mandrel of the safety joint from coming free from the housing during normal pipe string movement.

The anchor pipe safety joint is operated by neutralizing the weight of the pipe string at the location of the safety joint and rotating the pipe string to the right. The rotation backs off a left-hand exterior threaded nut within the housing.

U.S. Pat. No. 4,246,964 to Brandell, assigned to the assignee of the present invention, discloses a safety joint using reciprocation of the pipe string in conjunction with a fairly low level of right-hand torque on the downstroke of the string. This safety joint is designed for use in situations where torque applied to the tool string is limited by the ability of some tools in the string to withstand the torque.

Another prior art safety joint is the Halliburton Services RTTS safety joint, which operates in much the same manner as the above-mentioned VR safety joint, utilizing right-hand torque and pipe string reciprocation. However, the RTTS safety joint includes a tension sleeve which must be parted by application of a predetermined tensile force on the pipe string before the tool can be operated by reciprocation. A problem with this type of safety joint is that the release tension may not be as precisely determined as desired in some cases. Further, to vary the release tension, the tool must be broken down and the tension sleeve replaced.

The present invention provides a hydraulic safety joint which utilizes a hydraulically ruptured disc as the initial release mechanism. The amount of tension required to actuate this release mechanism is predetermined by the pressure rating of the rupture disc. This feature allows the release tension of the tool to be easily adjusted with no modifications to the tool other than changing the rupture disc itself. Further, the rupture disc has a very accurate burst pressure which makes determination of the release tension more precise than with previously known devices such as the tension sleeve type safety joints.

SUMMARY OF THE INVENTION

The hydraulic safety joint of the present invention is for use in a tool string and comprises case means for connecting to a tool string portion, mandrel means for connecting to another tool string portion and having a portion slidably disposed in the case means such that a chamber is defined therebetween, a volume of fluid in the chamber whereby the mandrel means and case means are maintained in an initial relative longitudinal position, and relief means for relieving pressure in the chamber upon application of a predetermined tensile load on the tool string and allowing relative longitudinal movement between the mandrel means and the case means. The mandrel means and case means have a second relative longitudinal position after application of the tensile load, and the apparatus further comprises means for preventing relative rotation between the mandrel means and case means when in the second position. A means for preventing relative rotation between the mandrel means and case means when in the initial position is also provided.

The hydraulic safety joint may comprise pressure balancing means for balancing a fluid pressure in the chamber with the pressure in the tool string prior to application of the tensile load. The mandrel means defines a port therethrough, and the pressure balancing means may be characterized by a piston disposed in the chamber. The piston has a side in communication with the port and another side in communication with the volume of fluid in the chamber. A sealing means is provided for sealingly isolating the fluid in the chamber. A means may also be provided for venting air from the chamber after it is filled with the volume of fluid.

In the preferred embodiment, the relief means is characterized by a rupture disc disposed on one of the case means and mandrel means and in communication with the chamber. The rupture disc is adapted for rupturing in response to a fluid pressure level in the chamber corresponding to the predetermined tensile load.

The means for preventing relative rotation between the mandrel means and case means when in the initial position may be characterized by a spline on the mandrel means engaged with a spline on the case means. Preferably, the spline on the case means is positioned on a nipple portion of the case means which is threadingly engaged with the rest of the case means. This threaded engagement preferably has a left-hand thread.

The means for preventing relative rotation between the mandrel means and the case means when in the second position may be referred to a lug means which comprises a case lug on the case means, a first piston lug on the pressure balancing piston and engageable with the case lug, a second piston lug on the piston, and a connecting lug in operative association with the mandrel means and engageable with the second piston lug. In an illustrated embodiment, the connecting lug is on a sleeve disposed in the chamber around the mandrel means, and the safety joint further comprises a sleeve lug on the sleeve, and a mandrel lug on the mandrel means which is engageable with the sleeve lug.

The present invention may also be described as a downhole tool comprising a lower tool string portion, a nipple connected to the lower tool string portion and defining a nipple spline therein, a case threadingly engaged with the nipple and defining a case central opening therethrough, a mandrel disposed in the case central opening such that a chamber is defined therebetween and having an end extending upwardly from the case, the mandrel defining a mandrel central opening therethrough and having a mandrel spline thereon engaged with the nipple spline when the mandrel is in a first position, an upper tool string portion connected to the end of the mandrel, a volume of fluid disposed in the chamber whereby the mandrel is initially held in the first position, a rupture disc in communication with the chamber, and means for preventing relative rotation between the mandrel and the case when the mandrel is in the second position. The rupture disc is adapted for rupturing in response to a pressure increase in the volume of fluid as a result of a tensile load applied to the tool string portion, whereby after rupturing of the disc, fluid is vented from the chamber such that the mandrel may be raised to a second position. The venting of the fluid is preferably to the mandrel central opening. The case may define a port therein whereby pressure on a portion of the mandrel is substantially equalized with a well annulus pressure.

An important object of the invention is to provide a safety joint which may be actuated precisely upon application of a predetermined tensile load on the tool string.

Another object of the invention is to provide a safety joint having a hydraulic pressure relief means for actuation thereof.

A further object of the invention is to provide a hydraulic safety joint having a mandrel means disposed in a case means and held in place by a volume of a fluid in a chamber defined therebetween with a rupture disc disposed on one of the case means and mandrel means for rupturing in response to a fluid pressure level in the chamber corresponding to a predetermined tensile load on the tool string.

Still another object of the invention is to provide a downhole tool having a hydraulic safety joint therein.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1:
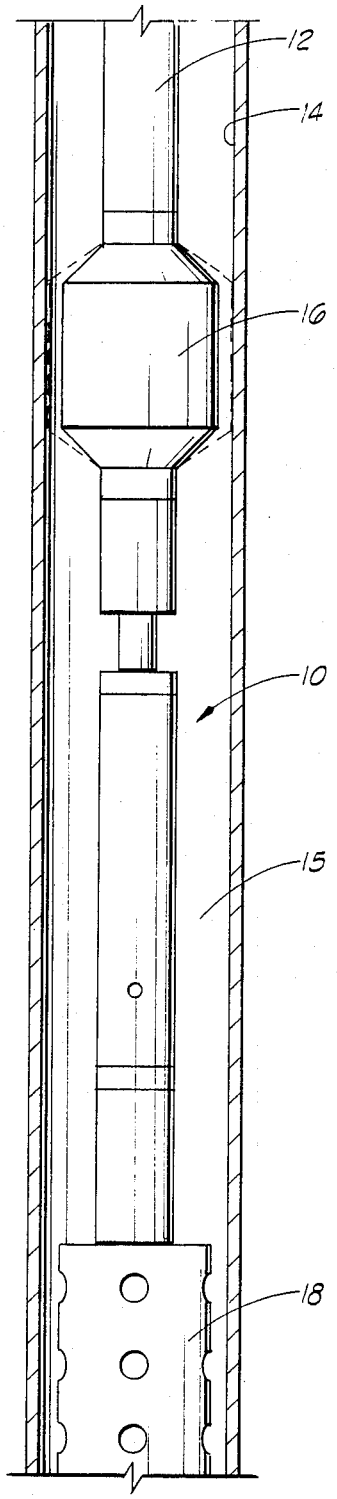
FIG. 1 shows the hydraulic safety joint of the present invention as part of a tool string in position in a well bore.

Referring now to the drawings, and more particularly to FIG. 1, the hydraulic safety joint of the present invention is shown and generally designated by the numeral 10. Safety joint 10 is part of a downhole tool string 12 for use in a well bore 14. When tool string 12 is positioned in well bore 14 a well annulus 15 is defined therebetween.

In the embodiment shown in FIG. 1, tool string 12 comprises an upper portion above safety joint 10 which includes a packer 16 and a lower portion below the safety joint which includes a perforating gun 18. Safety joint 10 is particularly well adapted for use between a packer and a perforating gun, but may also be used in other tool string locations in which a safety joint is desirable. It is not intended that the present invention be limited to the particular tool string configuration shown in FIG. 1.

Figure 2A:
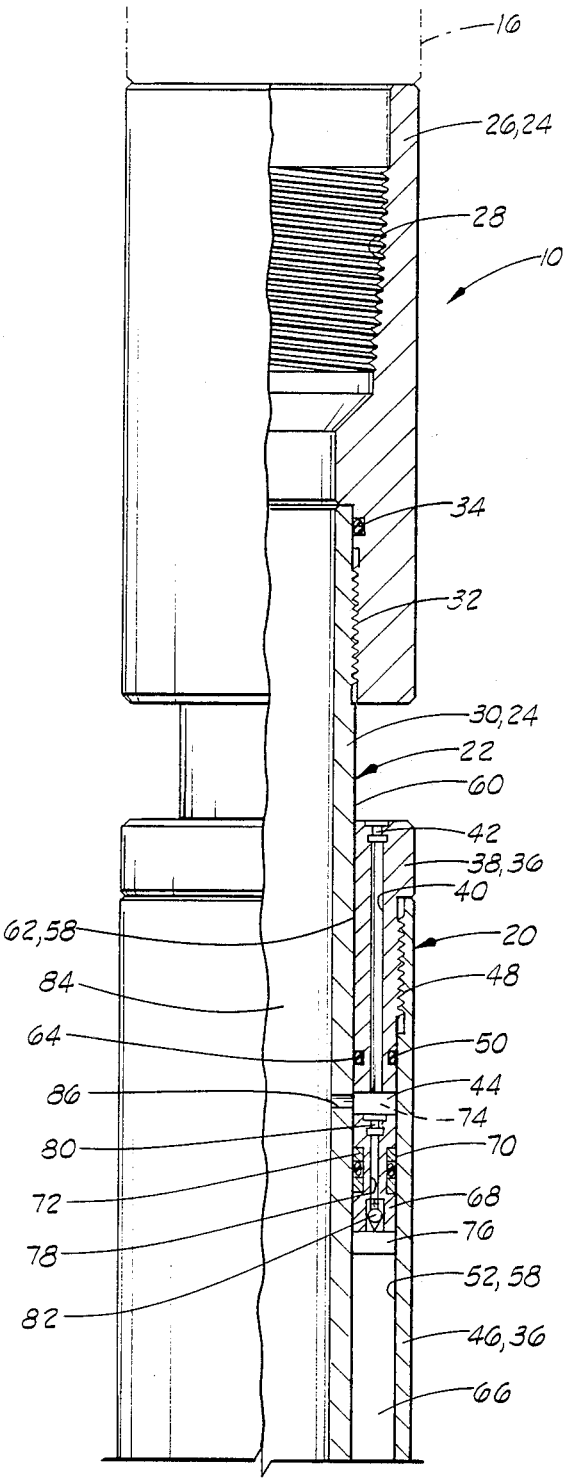
FIGS. 2A–2B illustrate a partial longitudinal cross section of the hydraulic safety joint.
Figure 2B:
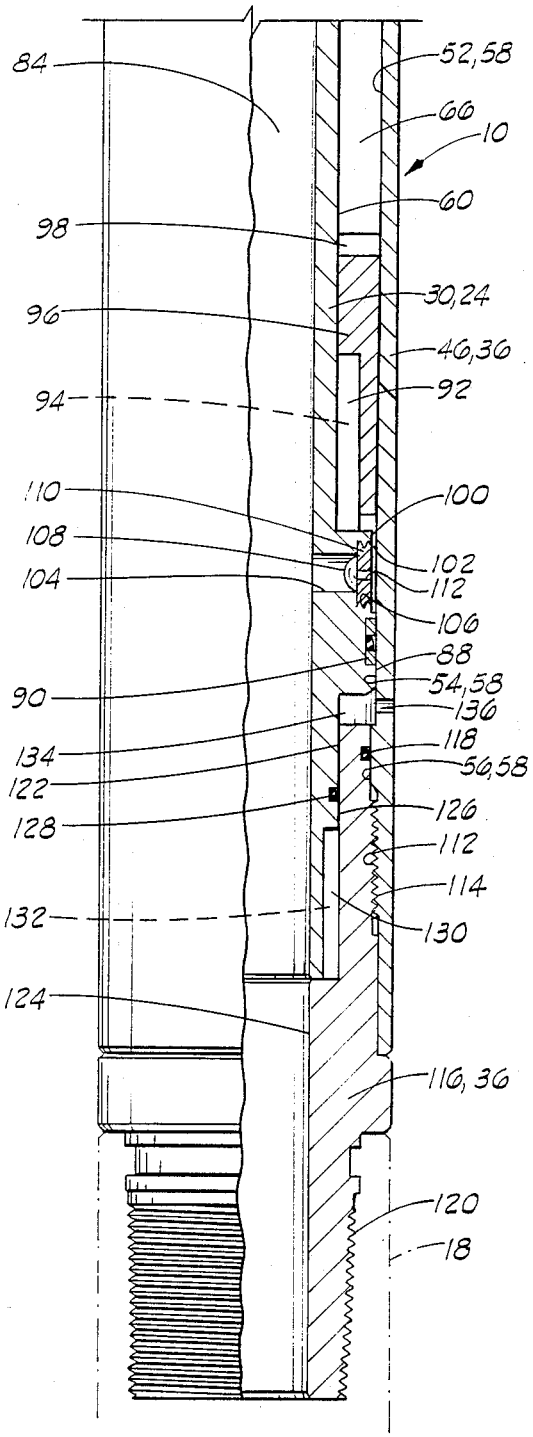

Referring now to FIGS. 2A–2B, the details of hydraulic safety joint 10 are shown. Safety joint 10 generally comprises a case means 20 for connecting to a tool string portion, such as perforating gun 18, and a mandrel means 22 for connecting to another tool string portion, such as packer 16. Mandrel means 20 has a portion slidably disposed in case means 20 and extends upwardly therefrom in the embodiment shown. However, safety joint 10 could be inverted with very few modifications, and it is not intended that the invention be limited to the particular orientation illustrated.

Mandrel means 20 may be characterized by an elongated mandrel assembly 24, at the upper end of which is a top adapter 26 having a threaded opening 28 therein which is connected to the upper tool string portion as seen in FIG. 2A. The lower end of top adapter 26 is attached to an operating mandrel 30 at threaded connection 32. A sealing means, such as O-ring 34, provides sealing engagement between top adapter 26 and operating mandrel 30.

Case means 20 is preferably characterized by an elongated case assembly 36 having at its upper end a top retainer 38. Top retainer 38 defines a longitudinally extending wrench way 40 therethrough which may be closed at its upper end by a plug 42. At the lower end of top retainer 38 is at least one downwardly extending case lug 44, also referred to as a top connecting lug 44.

Top retainer 38 is connected to a substantially tubular case 46 at threaded connection 48. A sealing means, such as O-ring 50, seals between top retainer 38 and case 46.

Case 46 has a first bore 52 therethrough with a slightly smaller second bore 54 therebelow. Below second bore 54 is an even smaller third bore 56. First, second and third bores 52, 54 and 56 in case 46 will be seen to form part of a case central opening 58 through case assembly 36.

A lower portion of operating mandrel 30 of mandrel assembly 24 is slidably disposed in case central opening 58. Operating mandrel 30 has a first outside diameter 60 which fits closely within bore 62 in top retainer 38. A sealing means, such as O-ring 64, provides sealing engagement therebetween. Bore 62 also forms part of case central opening 58.

First outside diameter 60 of operating mandrel 30 is spaced inwardly from first bore 52 of case 46 such that an elongated annular chamber 66 is defined therebetween. As will be further discussed herein, chamber 66 is filled with a volume of fluid, such as a silicon oil.

An annular, pressure balancing piston 68 is disposed in chamber 66 above the oil. Sealing means, such as outer seal 70 and inner seal 72, provide sealing engagement between piston 68 and bore 52 of case 46 and first outside diameter 60 of operating mandrel 30, respectively.

Extending upwardly from piston 68 is at least one first piston lug 74, also referred to as a top connecting lug 74, which is engageable with lug 44 on top retainer 38 when in the position shown in FIG. 2A. Extending downwardly from piston 68 is at least one second piston lug 76, also referred to as a middle connecting lug 76.

A longitudinally extending passage 78 is defined through piston 68 and is alignable with wrench way 40 in top retainer 38. As will be further discussed herein, the upper end of passage 78 may be closed by a plug 80. At the lower end of passage 78 is a spring biased pressure relief valve 82.

Operating mandrel 30 defines a central opening 84 therethrough which is in communication with the upper tool string portion. A tubing pressure communication port 86 is defined through operating mandrel 30, and initially, port 86 is disposed just below top retainer 38 adjacent to top connecting lugs 44 and 74. Thus, a pressure equalizing means is provided between central opening 84 and mandrel means 22 and chamber 66. Piston 68 is free to move in response to the pressure differential until the pressures are substantially equalized.

Referring now to FIG. 2B, operating mandrel 30 has an enlarged second diameter 88 which is in close spaced relationship with second bore 54 in case 46. A sealing means, such as seal 90, provides sealing engagement between second outside diameter 88 and second bore 54.

Above second outside diameter 88, operating mandrel 30 has at least one radially outwardly extending mandrel lug 92 thereon, also referred to as a lower lug 92. Lug 92 is engaged with a corresponding sleeve lug 94, also referred to as a lower lug 94, on a lug connecting sleeve 96. Lug connecting sleeve 96 is of generally annular configuration and is slidably disposed in chamber 66. At the upper end of lug connecting sleeve 96 is at least one upwardly extending sleeve lug 98, also referred to as a middle connecting lug 98. As will be further discussed herein, middle connecting lug 98 is adapted for engagement with middle connecting lug 76 on piston 68 after actuation of hydraulic safety joint 10.

Above seal 90, a recess 100 is formed in second outside diameter 88 of operating mandrel 30 such that a gap 102 is formed between the operating mandrel and second bore 54 of case 46. In the preferred embodiment shown, a transverse bore 104 with a threaded counterbore 106 at the outer end thereof extends through operating mandrel 30 adjacent to recess 100. Disposed across transverse bore 104 is a rupture disc 108 held in place by a threaded retainer 110. Threaded retainer 110 defines a hole 112 therethrough, and it will be seen by those skilled in the art that rupture disc 108 is thus in communication with chamber 66.

At the lower end of case 46 is a left-hand internal threaded bore 112. Initially engaged with threaded bore 112 is a left-hand external threaded portion 114 of a lower nipple 116. Lower nipple 116 is part of case assembly 36, but as will be seen further herein, the lower nipple is adapted to be disengaged from the remaining components of case assembly 36 after safety joint 10 has been actuated.

A sealing means, such as O-ring 118, provides sealing engagement between lower nipple 116 and third bore 56 of case 46. At the bottom of lower nipple 116 is a threaded portion adapted for connection with the lower tool string portion.

Lower nipple 116 defines a first bore 122 therethrough and a smaller second bore 124. A third outside diameter 126 of operating mandrel 30 extends downwardly into first bore 122 in lower nipple 116. A sealing means, such as O-ring 128, is provided for sealing engagement between operating mandrel 30 and lower nipple 116.

At the lowermost end of operating mandrel 30 is a male spline 130 which is engaged with a corresponding female spline 132 in lower nipple 116. Thus, in the initial position shown in FIGS. 2A and 2B, a means is provided for preventing relative rotation between operating mandrel 30 and lower nipple 116 and thus preventing relative rotation between mandrel means 22 and case means 20 when in the first or initial relative position shown in FIGS. 2A-2B.

An annular cavity 134 is defined between operating mandrel 30 and case 46 and is longitudinally located between second outside diameter 88 on the operating mandrel and the top of lower nipple 116. Case 46 defines a transverse annulus pressure communication port 136 therethrough which is in communication with cavity 134. Thus, a pressure equalizing means is provided for equalizing pressure between well annulus 15 and cavity 134.

Assembly And Operation Of The Invention

In FIGS. 2A and 2B, hydraulic safety joint 10 is shown in its initial, normal operating position. As already indicated, in this first position, spline 130 on operating mandrel 30 is engaged with spline 132 in lower nipple 116, and left-hand threaded portion 114 of the lower nipple is engaged with left-hand threaded bore 112 in case 46. Also in this position, lug connecting sleeve 96 is usually in the position shown wherein lower lugs 92 and 94 are engaged, although this is not really necessary initially.

As previously stated, chamber 66 is filled with a volume of fluid, such as a silicon oil. It is desirable that any air trapped therein be minimized. Therefore, in the preferred assembly procedure, the following steps are taken. First, all of the components are assembled as indicated except that top adapter 26, top retainer 38 and balancing piston 68 are not installed. Thus, at this point chamber 66 has an open upper end. With the tool held upright, the fluid is poured into chamber 66. Top retainer 38 and piston 68 are then slipped over operating mandrel 30 substantially simultaneously with top connecting lugs 44 and 74 engaged and plug 80 installed loosely in piston 68. Plug 80 is aligned with wrench way 40. Top connecting lugs 44 and 74 insure that plug 80 remains so aligned.

With the top connecting lugs 44 and 74 still engaged, top retainer 38 is slowly screwed into case 46 until threaded connection 48 is tight. During this operation, piston 68 is pushed down into chamber 66 such that air and oil are forced through pressure relief valve 82, around the plug 80 in piston 68 and out wrench way 40. Thus, an air vent means is provided. In one preferred embodiment, pressure relief valve 80 is designed to relieve at approximately 400 psi such that the fluid remaining in chamber 66 will be at that pressure initially.

Next, a wrench (not shown) is inserted through wrench way 40 in top adapter 38 to tighten plug 80, thereby closing off passage 78 in piston 68. Once plug 80 is tightened, it will be seen that pressure relief valve 82 no longer functions. Finally, plug 42 is installed in top retainer 38 to close off wrench way 40.

Using this assembly technique, most, if not all, of the air in chamber 66 will be forced out when pressure relief valve 82 opens. Since pressure relief valve 82 is designed to operate at a fairly high pressure, such as 400 psi, any small air bubbles remaining in chamber 66 will be compressed to small enough a volume that they will not allow any looseness or play in operating mandrel 30. It will therefore be seen by those skilled in the art that the fluid in chamber 66 prevents operating mandrel 30 from being moved upwardly from its initial operating position shown in FIGS. 2A and 2B as long as rupture disc 108 is intact.

Once hydraulic safety joint 10 has been assembled and installed into tool string 12, the tool string is lowered into well bore 14 to the desired location and the various well operations carried out. For the embodiment of tool string 12 illustrated, this would include actuating packer 16 into sealing engagement with well bore 14 as indicated by the dashed lines in FIG. 1, firing perforating guns 18 to perforate the well formation, and flowing fluids from the well formation as desired.

During operation, pressure may be increased in tool string 12 and thus in central opening 84 in operating mandrel 30. Even though the fluid in chamber 66 is preferably a silicon oil, the oil is not totally incompressible. Thus, as the pressure in central opening 84 is increased, this pressure is communicated through tubing pressure communication port 86 in operating mandrel 30 to the top of piston 68. Piston 68 will move within chamber 66 above the oil to compensate for this increase in pressure. Thus, the pressure in chamber 66 is always equalized with the pressure in central opening 84 by this actuation of piston 68, but the piston prevents communication between the fluids in central opening 84 and chamber 66.

Once well operations are finished, packer 16 is released, and tool string 12 removed from well bore 14. A problem that occurs is that perforating guns 18 frequently become stuck in well bore 14, thus making it difficult or impossible to unset packer 16 so that tool string 12 may be retrieved. Hydraulic safety joint 10 is designed for just such a situation and provides a way for tool string 12 to be actuated so that packer 16 may be released, thus recovering the tool string components above perforating guns 18 except lower nipple 116.

When it becomes necessary to actuate hydraulic safety joint 10, the operator applies a tensile load on tool string 12. This tensile load is, of course, applied to safety joint 10, resulting in a relative tensile load between mandrel means 22 and case means 20 tending to extend the mandrel means with respect to the case means. It will be seen that this increases the fluid pressure in chamber 66 because the upper end of chamber 66 is sealed by seals 70 and 72, and the lower end of the chamber is sealed by seal 90. Thus, a tensile force on operating mandrel 30 relative to case 46 tends to compress the fluid in chamber 66.

As previously indicated, rupture disc 108 is designed to rupture at a precisely determined pressure, and because the size of the components is known, this rupture pressure corresponds to a precisely determined tensile load on mandrel means 22. When this predetermined tensile load is reached, the corresponding pressure in chamber 66 is reached, and rupture disc 108 ruptures. When the rupture occurs, chamber 66 is opened, thus relieving the pressure in chamber 66.

Figure 3A:
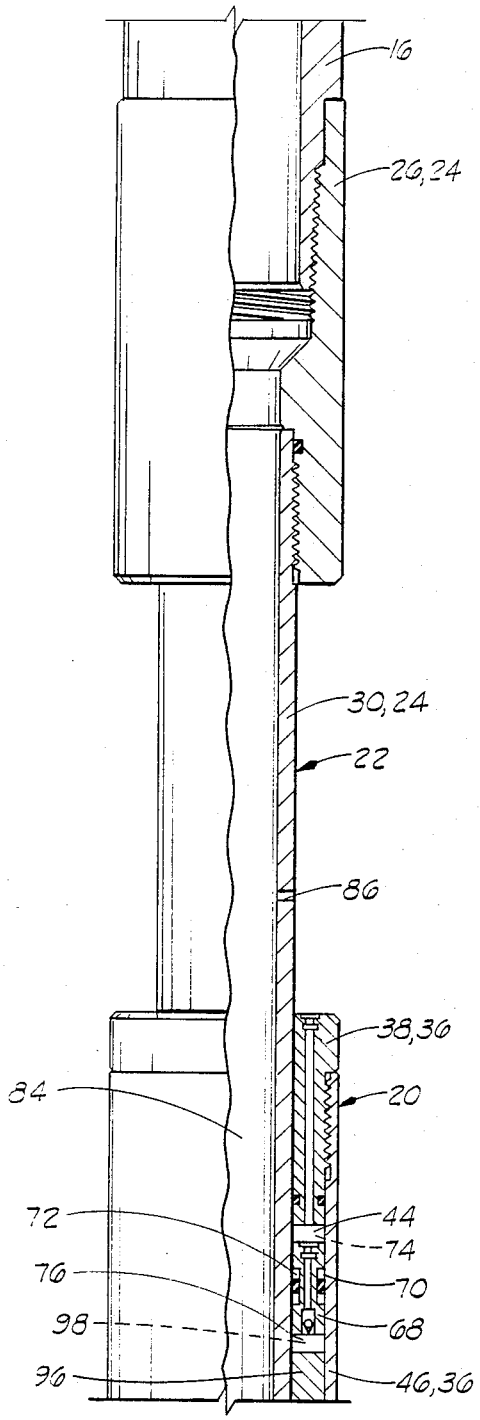
FIGS. 3A–3B show the hydraulic safety joint after actuating thereof and release from a lower tool string portion.
Figure 3B:
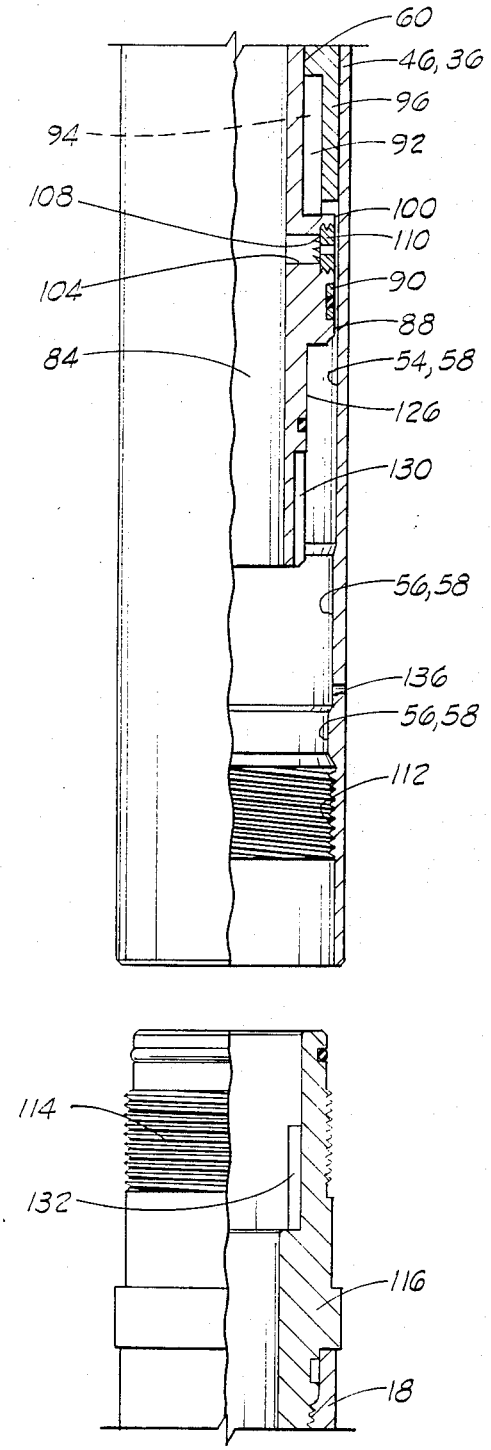

When the pressure is relieved, operating mandrel 30 is free to extend further from case 46 as seen in FIGS. 3A–3B. As mandrel 30 is raised upwardly within case 46, cavity 134 increases in size. Well annulus fluid enters cavity 134 through annulus pressure communication port 136 so that the pressure in cavity 134 and the well annulus is always equalized. In this way, the pressure below second diameter portion 88 of operating mandrel 30 is equalized with well annulus 15, and the upper movement of operating mandrel 30 is not impeded.

When operating mandrel 30 reaches its outermost extension point, corresponding to a second relative longitudinal position between mandrel means 22 and case means 20, middle connecting lug 98 on lug connecting sleeve 96 is engaged with middle connecting lug 76 on piston 68. Top connecting lugs 44 and 74 are still engaged, and lower connecting lugs 94 and 92 are still engaged as well. Thus, a means for preventing relative rotation between operating mandrel 30 and case 46, and between mandrel means 20 and case means 22, is provided.

When mandrel 30 is moved, spline 130 thereon is disengaged from spline 132 in lower nipple 116, and thus relative rotation between operating mandrel 30 and lower nipple 116 is no longer prevented. Once all of the lugs are engaged, right-hand torque can be applied to tool string 12 to break the connection between left-hand internal threaded bore 112 in case 46 and left-handed external threaded portion 114 on lower nipple 116. Once the left-hand threads 112 and 114 are disengaged, tool string 12 may be manipulated as necessary to unseat packer 16 and remove all of the tool string components above lower nipple 116 from well bore 14.

Once the upper tool string portion and hydraulic safety joint 10 except for lower nipple 116 are retrieved from well bore 14, a fishing tool of a kind known in the art may be lowered into the well bore to try to retrieve lower nipple 116 and perforating guns 18 in the lower tool string portion.

It will be seen, therefore, that the hydraulic safety joint of the present invention is well adapted to carry out the ends and advantages mentioned as well as those inherent therein. While a presently preferred embodiment of the invention has been shown for the purposes of this disclosure, numerous changes in the arrangement and construction of parts may be made by those skilled in the art. All such changes are encompassed within the scope and spirit of the appended claims.

What is claimed is:

1. A safety joint for use in a tool string comprising:

case means for connecting to a tool string portion;

mandrel means for connecting to another tool string portion and having a portion slidably disposed in said case means such that a chamber is defined therebetween;

a volume of fluid in said chamber whereby said mandrel means and said case means are maintained in an initial relative longitudinal position and prevented from relative longitudinal movement; and relief means for relieving fluid pressure in said chamber and allowing fluid to escape therefrom upon application of a predetermined tensile load on the tool string, thereby allowing relative longitudinal movement between said mandrel means and said case means.

2. The apparatus of claim 1 further comprising means for preventing relative rotation between said mandrel means and said case means when in said initial position.

3. The apparatus of claim 1 wherein said mandrel means and said case means have a second relative longitudinal position after application of said tensile load; and further comprising means for preventing relative rotation between said mandrel means and said case means when in said second position.

4. The apparatus of claim 1 further comprising pressure balancing means for balancing a fluid pressure in said chamber with a pressure in the tool string prior to application of said tensile load.

5. A safety joint for use in a tool string comprising:

case means for connecting to a tool string portion;

mandrel means for connecting to another tool string portion and having a portion slidably disposed in said case means such that a chamber is defined therebetween;

a volume of fluid in said chamber whereby said mandrel means and said case means are maintained in an initial relative longitudinal position; and relief means for relieving fluid pressure in said chamber upon application of a predetermined tensile load on the tool string and allowing relative longitudinal movement between said mandrel means and said case means, said relief means being characterized by a rupture disc disposed on one of said case means and mandrel means and in communication with said chamber, said rupture disc being adapted for rupturing in response to a fluid pressure level in said chamber corresponding to said predetermined tensile load.

6. A safety joint for use in a tool string comprising:

a case defining a case central opening therethrough;

a mandrel defining a mandrel central opening therethrough, and having an end slidably disposed in said case central opening such that a chamber is defined therebetween and an opposite end extending from said case, said mandrel further having a first position and a relatively further extended second position with respect to said case;

a volume of fluid disposed in said chamber;

sealing means for sealingly closing said chamber and retaining said fluid therein when said mandrel is in said first position; and means for preventing relative rotation between said mandrel and said case when said mandrel is in said first position.

7. The apparatus of claim 6 further comprising relief means in communication with said chamber for relieving pressure therein and allowing fluid to escape therefrom as a relative tensile force is applied to said mandrel and case tending to move said mandrel to said second position.

8. The apparatus of claim 6 wherein said mandrel defines a port therein in communication with said mandrel central opening; and further comprising a slidable piston in said chamber, said piston having a side in communication with said port and another side in communication with said volume of fluid such that a pressure of said volume of fluid and a pressure in said mandrel central opening are substantially equalized, at least when said mandrel is in said first position.

9. The apparatus of claim 8 further comprising lug means for preventing relative rotation between said case, mandrel and piston when said mandrel is in said second position.

10. A safety joint for use in a tool string comprising:

a case defining a case central opening therethrough;

a mandrel defining a mandrel central opening therethrough, and having an end slidably disposed in said case central opening such that a chamber is defined therebetween and an opposite end extending from said case, said mandrel further having a first position and a relatively further extended second position with respect to said case;

a volume of fluid disposed in said chamber;

sealing means for sealing said fluid in said chamber;

relief means in communication with said chamber for relieving pressure therein as a relative tensile force is applied to said mandrel and case tending to move said mandrel to said second position, said relief means comprising a rupture disc; and means for preventing relative rotation between said mandrel and said case when said mandrel is in said first position.

11. A safety joint for use in a tool string comprising:

a case defining a case central opening therethrough;

a mandrel defining a mandrel central opening therethrough and a port in communication with said mandrel central opening, said mandrel having an end slidably disposed in said case central opening such that a chamber is defined therebetween and an opposite end extending from said case, said mandrel further having a first position and a relatively further extended second position with respect to said case;

a volume of fluid disposed in said chamber;

sealing means for sealing said fluid in said chamber;

a slidable piston disposed in said chamber, said piston having a side in communication with said port and another side in communication with said volume of fluid such that a pressure of said volume of fluid and a pressure in said mandrel central opening are substantially equalized, at least when said mandrel is in said first position;

means for preventing relative rotation between said mandrel and said case when said mandrel is in said first position; and lug means for preventing relative rotation between said case, mandrel and piston when said mandrel is in said second position, said lug means comprising:

a case lug on said case;

a first piston lug on said piston and engageable with said case lug;

a second piston lug on said piston; and a connecting lug in operative association with said mandrel and engageable with said second piston lug.

12. The apparatus of claim 11 said connecting lug is on a sleeve disposed in said chamber; and further comprising:

a sleeve lug on said sleeve; and a mandrel lug on said mandrel and engageable with said sleeve lug.

13. A downhole tool comprising:

a lower tool string portion;

a nipple connected to said lower tool string portion and defining a nipple spline therein;

a case threadingly engaged with said nipple and defining a case central opening therethrough;

a mandrel disposed in said case central opening such that a chamber is defined therebetween and having an end extending upwardly from said case, said mandrel defining a mandrel central opening therethrough and having a mandrel spline thereon engaged with said nipple spline when said mandrel is in a first position;

an upper tool string portion connected to said end of said mandrel;

a volume of fluid disposed in said chamber whereby said mandrel is initially held in said first position;

a rupture disc in communication with said chamber, said rupture disc being adapted for rupturing in response to a pressure increase in said volume of fluid as a result of a tensile load applied to said upper tool string portion, whereby after rupturing of said disc, said fluid is vented from said chamber such that said mandrel may be raised to a second position; and means for preventing relative rotation between said mandrel and said case when said mandrel is in said second position.

14. The apparatus of claim 13 further comprising a pressure balancing piston in said chamber.

15. The apparatus of claim 14 wherein said means for preventing relative rotation comprises:

a sleeve disposed in said chamber and having first and second sleeve lugs thereon;

a mandrel lug on said mandrel engageable with said first sleeve lug;

first and second piston lugs on said piston, said first piston lug being engageable with said second sleeve lug when said mandrel is in said second position; and a case lug in said case central opening engageable with said second piston lug.

16. The apparatus of claim 14 further comprising means for venting air from said chamber after said piston is installed in said chamber.

17. The apparatus of claim 16 wherein said venting means is characterized by:

said case defining a wrench way therein; and said piston defining a passage therein alignable with said wrench way and through which air may be vented.

18. The apparatus of claim 17 further comprising a plug positionable across said passage for closure thereof, said plug being tightenable by a wrench positioned through said wrench way.

19. The apparatus of claim 17 further comprising a relief valve in said passage.

20. The apparatus of claim 13 wherein said case defines a port therein whereby pressure on a portion of said mandrel is substantially equalized with a well annulus pressure.

* * * * *